United States Patent [19]

Mathieu

[11] 4,330,080

[45] May 18, 1982

[54] SEPARATOR FOR AN ULTRACENTRIFUGE

[75] Inventor: Bernd Mathieu, Spiesen, Fed. Rep. of Germany

[73] Assignee: Dr. Eduard Fresenius, Chemisch-pharmazeutische Industrie KG Apparatebau KG, Bad Homburg, Fed. Rep. of Germany

[21] Appl. No.: 206,447

[22] Filed: Nov. 13, 1980

[30] Foreign Application Priority Data

Nov. 30, 1979 [DE] Fed. Rep. of Germany ..... 2948177

[51] Int. Cl.[3] ..... B04B 5/00

[52] U.S. Cl. ..... 233/27

[58] Field of Search ..... 233/27, 28, 21, 1 R, 233/1 D, 14 R, 14 A, 16, 37, 34, 35, 36, 40, 44, 32

[56] References Cited

U.S. PATENT DOCUMENTS

| | | | |
|---|---|---|---|
| 3,858,796 | 1/1975 | Unger | 233/27 |
| 4,007,871 | 2/1977 | Jones | 233/27 |
| 4,010,894 | 3/1977 | Kellogg | 233/27 |
| 4,076,169 | 2/1978 | Schultz | 233/27 |

*Primary Examiner*—Robert W. Jenkins

*Attorney, Agent, or Firm*—Andrus, Sceales, Starke & Sawall

[57] ABSTRACT

A separator shaped like a plate, for an ultracentrifuge, comprises centrally arranged inlet and outlet nipples (5, 6, 7, 8) opening axially outwardly. A ring channel (11) is arranged near the circumference of the plate (1) and extends along or near substantially the entire circumference. One end, the inlet end, of the ring channel is connected through a respective radially extending duct (10) to the inlet nipple (5). The other end of the ring channel (11) opens into at least one separation zone (17) which is widened relative to the ducts. The separation zone (17) is connected through approximately radially further ducts (12, 14, 15) to the outlet nipples (6, 7, 8). Peeling edges (18, 20, 21) project into the separation zone (17) and form a radially outwardly located boundary of the inflow areas of the connecting ducts (12, 14, 15). These ducts (12, 14, 15) merge into the separation zone (17) behind the peeling edges at different radial spacings in the rotational direction (9).

10 Claims, 10 Drawing Figures

SEPARATOR FOR AN ULTRACENTRIFUGE

CROSS-REFERENCE TO RELATED APPLICATION

The present invention corresponds to German Patent Application No. P 2,948,177.4, filed in the Federal Republic of Germany on Nov. 30, 1979. The priority of said German filing date is hereby claimed.

BACKGROUND OF THE INVENTION

The invention relates to a separator shaped like a plate for use in an ultracentrifuge comprising centrally arranged inlet and outlet nipples opening axially outwardly, and at least one ring channel arranged near the circumference of the plate. The ring channel extends along substantially the entire circumference and merges at least into one separation zone which is widened relative to the ring channel. The separation zone is connected through approximately radial conduits or ducts to the inlet and outlet nipples.

Such a separator is known from U.S. Pat. No. 4,007,871. The known separator, however, has the disadvantage that channels opening into the separation zone merely end on different radii, whereby the channels extend approximately radially to the axis for discharging the different fractions which are collecting in a discharge zone. Thus, a careful, exact separation of the fractions is not entirely assured.

Further, said known separator is produced of soft films welded to one another and must be placed into a receptacle in the centrifuge in which it floats in a liquid. The liquid quantity to be introduced must be dosed very precisely. Thus, this known separator is only of limited utility in its practical operation. Similar considerations apply to the separator disclosed in U.S. Pat. No. 4,010,894.

OBJECTS OF THE INVENTION

In view of the above it is the aim of the invention to achieve the following objects singly or in combination:

to provide a separator for fractionating liquid in an ultracentrifuge in a perfect, highly efficient manner, particularly for use as a throughflow separator for separating blood into its components or fractions for avoiding the above shortcomings;

to improve a separator of the mentioned type in such a manner that the so-called peeling effect is utilized at least once, preferably repeatedly;

to combine the effect of centrifugal forces with the peeling effect for an efficient blood separation; and to construct a blood centrifugal separator for producing high concentrate of thrombocytes on the one hand and a blood plasma substantially free of thrombocytes on the other hand.

SUMMARY OF THE INVENTION

According to the invention there are provided in a separator of the type mentioned above separating or peeling edges which project into the separation zone or zones and which bound the inflow areas of the connecting ducts radially outwardly. Further connecting ducts merge into the separation zone behind the edges on different radial spacings as viewed in the rotational direction.

According to one embodiment of the invention it is advantageous that the separator is constructed as a disk having radial reinforcing ribs. The ring channels are formed as troughs or grooves having walls which project from one side of the disk or which are open toward one side of the disk so that the disk forms three walls of the troughs or grooves. A plane, circular plate is tightly connected to the disk to cover the open side of the troughs or grooves. The cover plate has about the same diameter as the disk and forms a fourth wall for the troughs or grooves.

BRIEF FIGURE DESCRIPTION

In order that the invention may be clearly understood, it will now be described, by way of example, with reference to the accompanying drawings, wherein.

Figure 1:
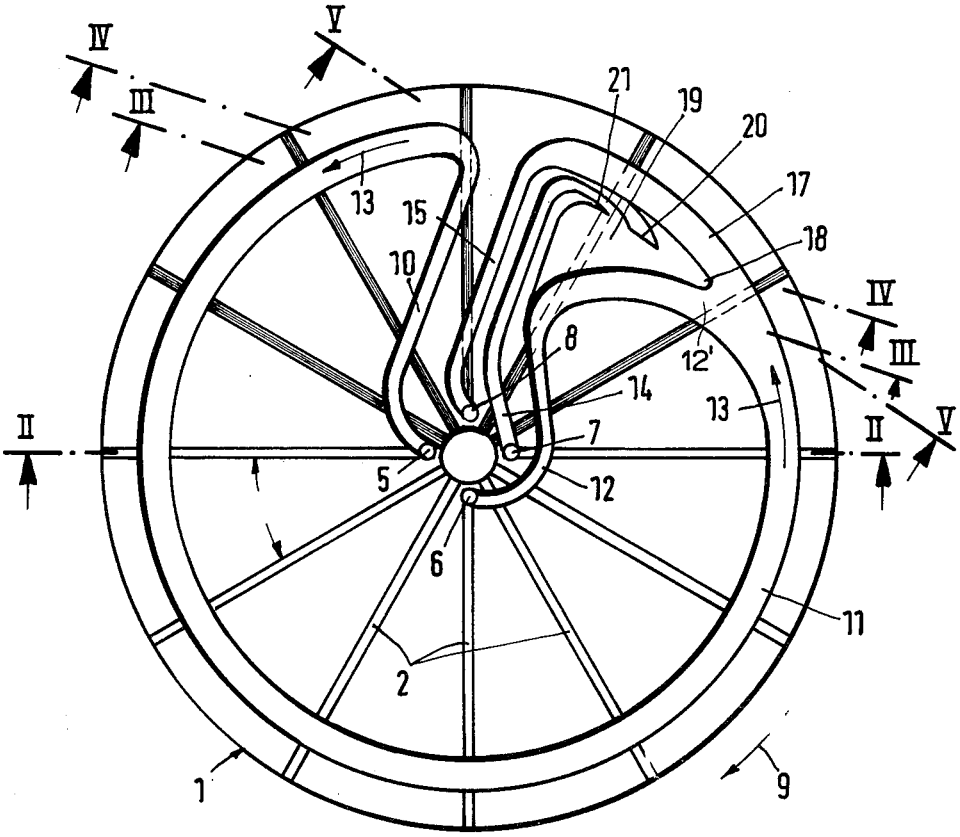
FIG. 1 shows a top plan view onto the lower portion of a separator according to the invention carrying the channels.

DETAILED DESCRIPTION OF PREFERRED EXAMPLE EMBODIMENTS AND OF THE BEST MODE OF THE INVENTION

A separator according to the invention comprises a base plate 1 having formed thereon reinforcing ribs 2. A cover plate 3 is rigidly connected in a sealed manner to the base plate 1. A central opening 4 extending entirely through the base plate and through the cover plate, may be used for securing the separator in a centrifuge. As may be seen from FIGS. 3 to 5, the base plate 1 is preferably formed as a disk and comprises mold formations which form channels and ducts to be described in more detail below. The base plate 1 is preferably made as an injection molded part of a suitable synthetic material.

The base plate 1 and cover plate 3 form a housing which has a rotation axis 4' extending through the central hole 4. The means for securing the cover 3 to the base 1 are not shown because they are conventional. The cover plate 3 is provided close to the central axis 4'' with inlet means and outlet means in the form of nipples 5 to 8 connected to the ends of substantially radially extending first ducts 10, 12 and second ducts 14, 15 which extend close to the central axis 4'.

After insertion into a centrifuge the separator is driven to rotate in the direction of the arrow 9, e.g. clockwise, shown in FIG. 1.

Figure 2:
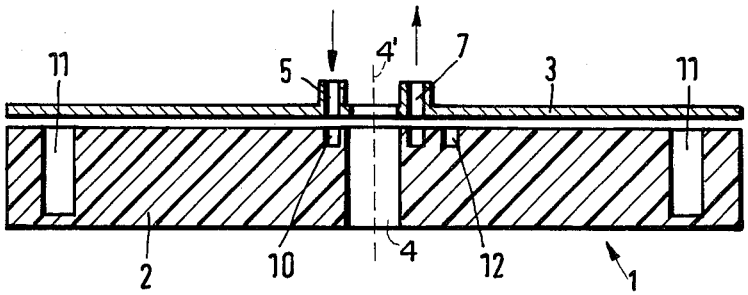
FIG. 2 is a sectional view along section line II—II in FIG. 1.
Figure 4:
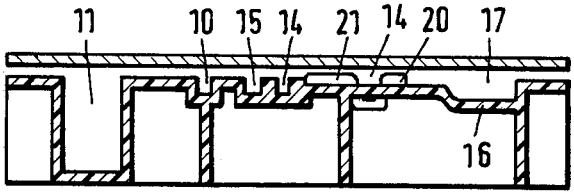
FIG. 4 is a sectional view along section line IV—IV in FIG. 1.
Figure 3:
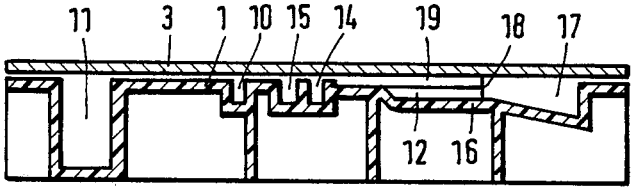
FIG. 3 is a sectional view along section line III—III in FIG. 1.
Figure 9:
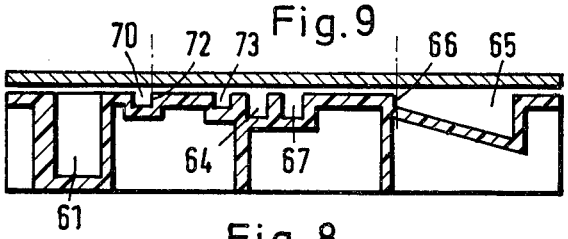
FIG. 9 is a sectional view along section line IX—IX in FIG. 6.
Figure 8:
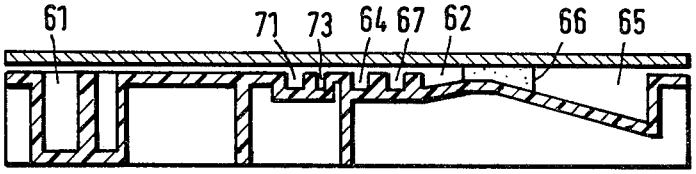
FIG. 8 is a sectional view along section line VIII—VIII in FIG. 6.
Figure 7:
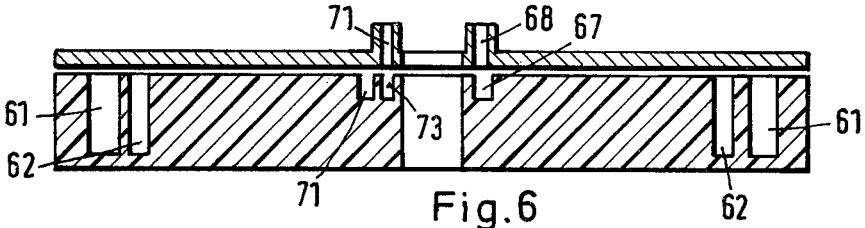
FIG. 7 is a sectional view along section line VII—VII in FIG. 6.
Figure 6:
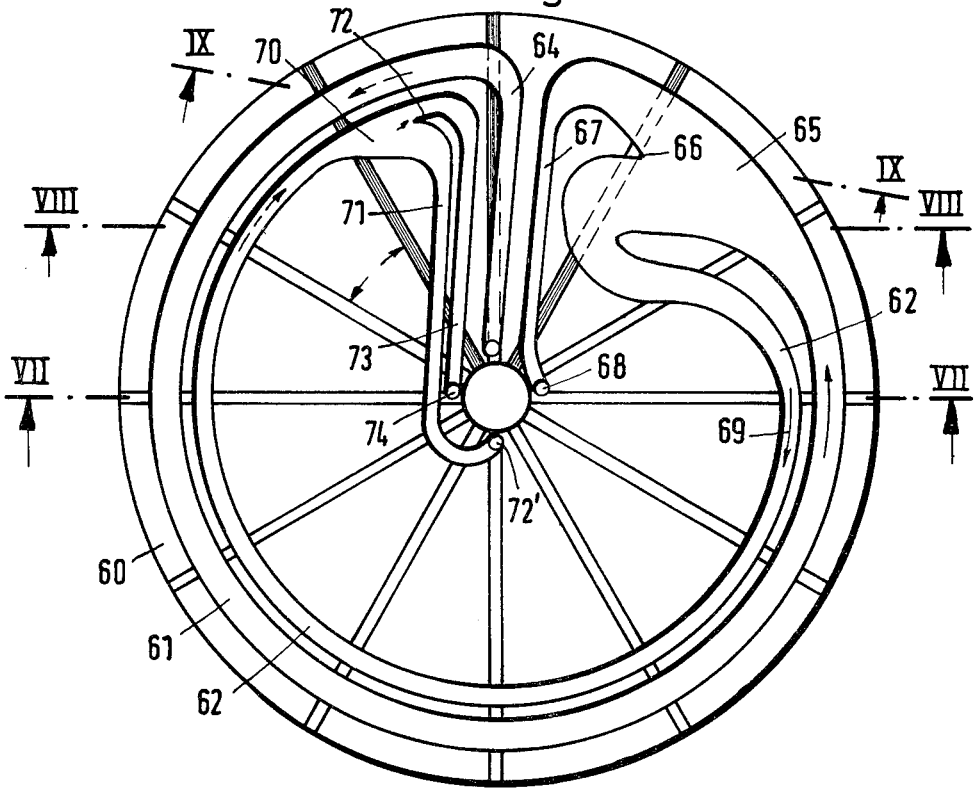
FIG. 6 is a view corresponding to FIG. 1 of a second embodiment of the invention.

The duct 10 extends approximately radially from the connecting inlet nipple 5 for supplying blood into the ring channel 11 which merges into a duct 10 close to the radially outer edge of the disk shaped base plate 1. This ring channel 11 extends along most of the circumference of the base plate 1 or alongside the circumference and merges into a separation zone 17 to be described in more detail below. A duct 12 branches off from the ring channel 11 at the inlet end 12' of the duct 12. The duct 12 leads into a return flow or outlet nipple 6. The liquid to be fractionated flows through the ring channel 11 in the direction of the arrows 13. As shown in FIGS. 2 to 4, this ring channel 11 has a relatively large depth and a predetermined cross-section. Three walls of this channel 11 are formed by the mold formations in the base plate 1, whereas the fourth channel wall is formed by the cover plate 3.

A second set of ducts includes a duct 14 extending approximately radially from the connecting outlet nipple 7 to the separation zone 17 and a duct 15 extending from the connecting outlet nipple 8 toward the separation zone 17 for removing the fractions or components out of the separator.

It is seen from the sectional views of FIGS. 2 to 5 that the ducts 12, 14, and 15 have a cross-section each of which is smaller than the cross-section of the ring channel 11. At best, the sum of the cross-sectional areas of the individual ducts is equal to that of the ring channel 11.

Figure 5:
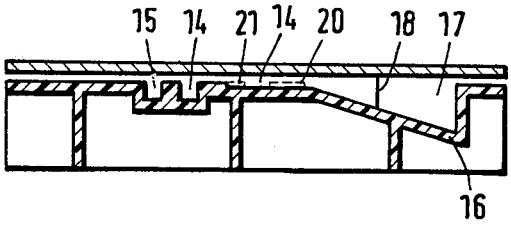
FIG. 5 is a sectional view along section line V—V in FIG. 1.

The formation of the separation zone 17 and the respective location of the radially outer inlets of the ducts 12, 14, and 15 in the separation zone is of importance for the function of the separation zone of the separator according to the invention. Thus, the sectional views of FIGS. 3 to 5 are provided for showing that the separation zone 17 has a lower wall 16 which forms the bottom and defines the height or depth of the separation zone 17 so that the depth decreases in the flow direction. The ring channel 11 continues or extends into a portion of the separation zone 17 which has a depth smaller than the channel 11 and larger than the remainder of the separation zone 17.

A location 18 is visible in the rotational direction of the disk 1 behind the branching off of the duct 12 from the channel 11. Behind this location there begins a rising, flatter area 19 (FIG. 3) of the separation zone 17. This flatter area 19 is more clearly evident from FIGS. 1 and 3.

In the flatter area 19 of the separation zone 17 a first peeling edge 20 is formed in front of the inlet to the duct 14 and a further edge 21 is formed behind the inlet of this duct 14, please see the sectional views of FIGS. 4 and 5.

Figure 10:
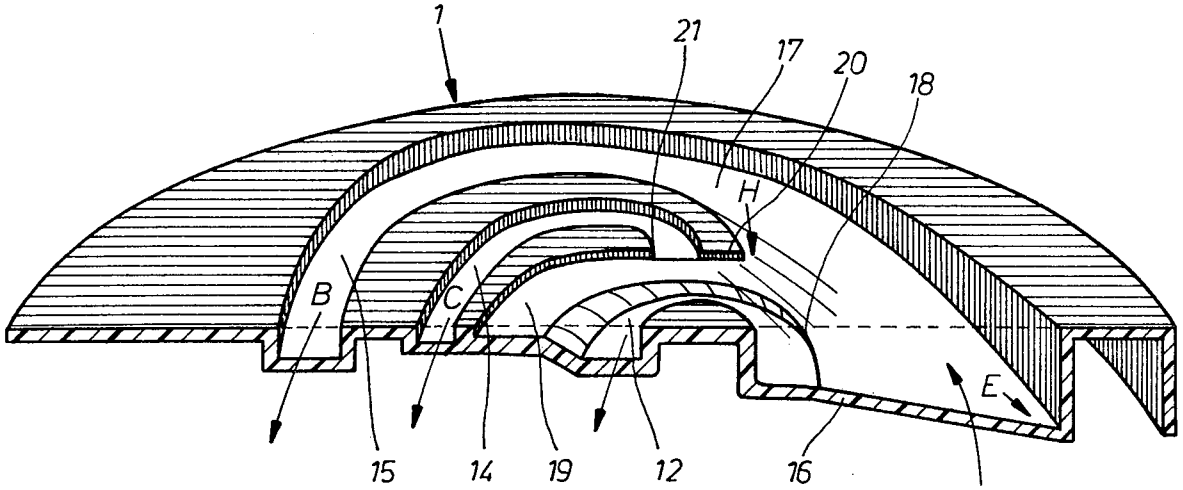
FIG. 10 is a perspective top view onto the separation zone of a separator according to the invention.

The operation of the above described apparatus will be described in the following with reference to the illustration of FIG. 10. The liquid to be fractionated, as for example blood, enters through the nipple 5 into the duct 10 and thereafter into the ring channel 11 and flows through the ring channel 11 while the separator rotates. During this through-flowing a separation already takes place in the ring channel 11 whereby the channel 11 functions as a separation chamber. Due to the larger cross-section of this channel 11 the throughflow speed is lower than the throughflow speed in the supply duct 10. At the end of this separation chamber or ring channel 11 one may already distinguish between three fractions, namely, between the red and white blood cells and the plasma. The plasma is supplied through the duct 12 to the outlet nipple 6. The red blood cells travel through the separation zone 17 and the duct 15 to the outlet nipple 8.

In order to meet the withdrawal location of the white blood cells with which the present example is primarily concerned, as precisely as possible, this area is widened by reducing the depth of the separation chamber while increasing its width to form a zone 19. The edge 18 "peels off" the desired fraction of the white blood cells from the red blood cells and leads them with a portion of the plasma into the inlet end 12 of the duct 12.

A slight negative pressure is now applied to the connecting nipple 7 of the duct 14. The size of the negative pressure determines the quantity of the fraction of the white blood cells which flow back out of the zone 19. The peeling edges 20 and 21 hereby serve for the further fractionating at the zone 19 after the separation between the white blood cells and the red blood cells and the plasma which takes place in the zone 11 due to the centrifugal force.

Outside the housing formed by the base plate 1 and cover disk 3 the connecting nipples 5 to 8 are connected in a known manner to a multiple hose (not shown) which in turn is connected outside of the centrifuge to a supply and/or withdrawal head. The construction of these components is known as such and thus does not require any further discussion.

The example embodiment according to FIGS. 6 to 9 constitutes a further improvement of the above described example embodiment of FIGS. 1 to 5. In this second embodiment two parallel ring channels 61 and 62 are arranged in the disk shaped base plate 60. The supply of the liquid to be fractionated takes place through one supply nipple 63 and a supply duct 64 into the outer ring channel 61. The channel 61 merges into a separation zone 65 in which the inner ring channel 62 branches off in front of a peeling edge 66. The outer ring channel merges into a return guide duct 67 which empties into a connecting nipple 68.

The heavier fraction (red and white blood cells) is discharged through the duct 67 and the plasma with the blood platelets therein is supplied oppositely through the ring channel 62, that is, in the direction of the arrow 69 into a second separation chamber 70. During the flowing through the inner ring channel 62 a substantial separation takes place of these two fractions due to the centrifugal effect. The lighter fraction, in the stated example the blood plasma, is supplied through a return guide duct 71 to a connecting nipple 72'. A peeling edge 72 is provided in the separation zone 70 behind which a duct 73 leads to the connecting nipple 74.

The separation zone 70 corresponds in its mode of operation to the zone 19 of the embodiment of FIG. 1. The operation of the peeling edge 72 corresponds to that of the peeling edge 20 of the mentioned example embodiment. The duct 73 corresponds to the duct 14 of the example embodiment of FIG. 1. Thus, a negative pressure may also be applied to the duct 73.

The travel distance of the blood platelets in the ring channel 62 is only half as large as in the ring channel 61. However, the centrifugal force is almost equal to that in the channel 61. Therefore, a more effective separation of the plasma and the blood platelets can be achieved so that the plasma flowing back through the channel 71 comprises only merely very few blood platelets. Accordingly, this example embodiment is especially suitable for gaining a concentrate of thrombocytes or of a blood plasma which is free of thrombocytes.

Although the invention has been described with reference to specific example embodiments, it is to be understood, that it is intended to cover all modifications and equivalents within the scope of the appended claims.

What is claimed is:

1. A separator for separating the components of a fluid into a number of fractions in an ultracentrifuge, comprising a first substantially circular plate member having a central rotational axis, a second plate member forming a cover so that said first and second plate members form a housing, ring channel means in said housing extending along a substantial portion of the circumference of said housing, fluid inlet means arranged in said housing substantially centrally thereof relative to said rotational axis, first substantially radially extending duct means operatively interconnecting said fluid inlet means to one end of said ring channel means for feeding fluid into said ring channel means, fluid component outlet means arranged in said housing also substantially centrally thereof relative to said rotational axis, separation zone means located radially outwardly in said housing opposite the other end of said ring channel means so that the other end of the ring channel means merges into said separation zone means, second substantially radially extending duct means operatively interconnecting said fluid component outlet means to said separation zone means for removing fluid components through said fluid component outlet means, and separator edge means operatively located in said separation zone means for causing a peeling effect in said separation zone means, said edge means forming boundaries of said second substantially radially extending duct means where the latter merge into said separation zone means so that said second cut means are located downstream of said edge means as viewed in the fluid flow direction, said second substantially radially extending duct means including a number of second ducts of different radial length whereby said peeling effect is repeated.

2. The separator of claim 1, wherein said separation zone means in said housing has a depth, as viewed in said axial direction, which diminishes in the fluid flow direction.

3. The separator of claim 1, wherein said ring channel means extend in said housing at a radial spacing from said central axis which is constant substantially along the entire length of said ring channel means.

4. The separator of claim 1, wherein each of said first and second substantially radially extending duct means has a cross-sectional area which is smaller than that of said ring channel means whereby the sum of the cross-sectional areas of said first and second duct means is, at the most, equal to the cross-sectional area of the ring channel means.

5. The separator of claim 1, wherein said fluid component outlet means comprise a number of component outlets corresponding to said number of ducts of said second duct means, said number also corresponding to said number of fractions to be obtained.

6. The separator of claim 5, wherein said separator edge means comprise a number of edges also corresponding to said number of second ducts and of said outlets.

7. The separator of claim 1, wherein each of said number of second ducts has an inflow area adjacent its respective separator edge means, each of said inflow areas having a cross-section corresponding to the quantity of the fraction flowing through the respective inflow area whereby the total cross-section of all inflow areas corresponds to the total flow quantity of fluid flowing into all of the second ducts.

8. The separator of claim 1, wherein said ring channel means comprise first and second ring channels arranged substantially concentrically relative to said rotational axis, said separation zone means also comprising first and second separation zones, said ring channels merging into their respective separation zones.

9. The separator of claim 1, wherein said first, substantially circular plate member is a disk comprising radial reinforcing ribs, and wherein said ring channel means and said first and second duct means are formed in said disk as grooves or troughs having an open face toward one side of the disk, said second plate member covering said open face to form a fourth groove or through wall, said first and second plate members having substantially the same diameter.

10. The separator of claim 9, wherein said liquid inlet means and said component or fraction outlet means extend axially outwardly adjacent to said rotational axis through one of the plate members.

* * * * *